US006847328B1

(12) United States Patent
Libonati et al.

(10) Patent No.: US 6,847,328 B1
(45) Date of Patent: Jan. 25, 2005

(54) COMPACT ANTENNA ELEMENT AND ARRAY, AND A METHOD OF OPERATING SAME

(75) Inventors: Russell W. Libonati, Largo, FL (US); Steven D. Eason, Largo, FL (US)

(73) Assignee: Raytheon Company, Waltham, MA (US)

( * ) Notice: Subject to any disclaimer, the term of this patent is extended or adjusted under 35 U.S.C. 154(b) by 37 days.

(21) Appl. No.: 10/352,264

(22) Filed: Jan. 27, 2003

Related U.S. Application Data

(60) Provisional application No. 60/360,912, filed on Feb. 28, 2002.

(51) Int. Cl.[7] ..... H01Q 1/38

(52) U.S. Cl. ..... 343/700 MS; 343/795; 343/797

(58) Field of Search ..... 343/700 MS, 725, 343/741, 793, 795, 797

(56) References Cited

U.S. PATENT DOCUMENTS

| | | | | |
|---|---|---|---|---|
| 4,710,775 | A | 12/1987 | Coe | 343/727 |
| 4,833,485 | A | 5/1989 | Morgan | 343/895 |
| 5,300,936 | A * | 4/1994 | Izadian | 343/700 MS |
| 5,696,372 | A * | 12/1997 | Grober et al. | 250/216 |
| 5,926,150 | A | 7/1999 | McLean et al. | 343/846 |
| 5,945,962 | A | 8/1999 | Harrington et al. | 343/792.5 |
| 5,952,971 | A * | 9/1999 | Strickland | 343/700 MS |
| 6,133,878 | A * | 10/2000 | Lee | 343/700 MS |
| 6,208,306 | B1 | 3/2001 | McLean et al. | 343/747 |
| 6,329,655 | B1 * | 12/2001 | Jack et al. | 250/338.1 |
| 6,329,949 | B1 * | 12/2001 | Barnett et al. | 343/700 MS |
| 6,507,320 | B2 | 1/2003 | Von Stein et al. | 343/770 |

OTHER PUBLICATIONS

Qian, et al., "Progress in Active Integrated Antennas and Their Applications", IEEE Transactions on Microwave Theory and Techniques, vol. 46, No. 11, Nov. 1998, pp. 1891–1900.

Yarovoy, et al., "Ultra–Wideband Antennas for Ground Penetrating Radar", International Research Centre for Telecommunications–transmission and Radar, Delft, The Netherlands, 5 unnumbered pages, date unknown.

"Ninth Progress Report on the research project Improved Ground Penetrating Radar Technology", Delft University of Technology, Delft, The Netherlands, 6 unnumbered pages, date unknown.

Radzevicius, et al., "Pitfalls in GPR Data Interpretation: Differentiating Stratigraphy and Buried Objects from Periodic Antenna and Target Effects", Geophysical Research Letters, vol. 27, No. 20, Ohio State University, Columbus, Ohio, pp. 3393–3396, Oct. 15, 2000.

(List continued on next page.)

*Primary Examiner*—Shih-Chao Chen
(74) *Attorney, Agent, or Firm*—Baker Botts L.L.P.

(57) ABSTRACT

An antenna element includes a section which is electrically non-conductive, a plurality of electrically conductive patches on the section which each face in a predetermined direction, a feed arrangement electrically coupled to the patches, and an annular strip of conductive material supported on the section and extending around the patches free of electrical contact therewith. A plurality of these antenna elements can be used to form an array, where one of the antenna elements has several other antenna elements provided at spaced locations around it. Each antenna element can include, on a side of the section opposite from the patches, an electrically-conductive portion with a cavity which faces the section.

30 Claims, 4 Drawing Sheets

OTHER PUBLICATIONS

Lestari et al., "Capacitively–Tapered Bowtie Antenna", International Research Centre for Telecommunications–transmission and Radar, Delft, The Netherlands, 4 unnumbered pages, date unknown.

Kempel, et al., "Radiation by Cavity–Backed Antennas on a Circular Cylinder", IEEE Proceedings—Microwave Antennas Propagation., vol. 142, No. 3, Jun. 1995, pp 233–239.

Gong, et al., "Characterization of Cavity–Backed Comformal Antennas and Arrays Using a Hybrid Finite Element Method with Tetrahedral Elements", The University of Michigan, Ann Arbor, Michigan, 1992, pp. 1629–1632.

Auckland, et al., "A Procedure to Calculate the in–situ Contribution to Body Scattering Caused by Conformal Cavity–Backed Apertures", Atlantic Aerospace Electronics Corp., Greenbelt, Maryland, 1995, pp. 1764–1767.

Baudou, et al., "Analysis of a Conformal Cavity–Backed Patch Antenna Using a Hybrid MoM/FEM Technique", Université Paul Sabatier, Cedex, France, 2001, pp. 354–357.

Bailey, "Broad–Band Half–Wave Dipole", IEEE Transactions on Antennas and Propagation, vol. AP–32, No. 4, Apr. 1984, cover page and pp. 410–412.

* cited by examiner

COMPACT ANTENNA ELEMENT AND ARRAY, AND A METHOD OF OPERATING SAME

This application claims the priority under 35 U.S.C. §119 of provisional application No. 60/360,912 filed Feb. 28, 2002.

GOVERNMENT INTEREST

This invention was made with Government support under Contract No. N00039-00-9-2224 awarded by the Department of the Navy. The Government has certain rights in this invention.

TECHNICAL FIELD OF THE INVENTION

This invention relates in general to antennas and, more particularly, to antenna arrays suitable for use with global positioning satellite systems.

BACKGROUND OF THE INVENTION

In January, 1999, the Johns Hopkins University Applied Physics Laboratory (APL) released a Global Positioning Satellite (GPS) risk assessment study. This study was carried out because GPS is being evaluated for possible use as the sole basis for airplane navigation in U.S. national airspace. The study concluded that the only significant risk was interference (intentional or unintentional). The study went on to outline three primary sources of unintentional interference, which are: (1) out-of-band television transmissions, (2) very high frequency (VHF) broadcasts, and (3) over-the-horizon (OTH) military radar. The study recommended the use of antenna nulling and signal processing techniques to overcome any kind of interference.

One specific of the use of GPS for airplane navigation is that GPS has become a significant, enabling technology for present and future military fighter jets. GPS technology is being utilized for many other military aspects as well, and is forming the foundation for new paradigms in military tactics. As a result, the U.S. military is growing increasingly reliant on GPS.

The success of a mission and the lives of troops can often depend on the accuracy and availability of a GPS system. Therefore, signal denial is a major concern, whether it is caused intentionally or unintentionally. For this reason, many military GPS systems use specialized antenna arrays, called controlled reception pattern antennas (CRPAs), which can work in conjunction with integrated electronics to adaptively cancel (or null) unwanted signals. These antennas and the associated electronics are often referred to generically as anti-jam antenna systems.

Many branches of the military are now deciding to add anti-jam capabilities to their existing GPS systems. This trend will carry over to many commercial/civil organizations in the near future. Beginning with GPS satellites planned for launch in 2005, two additional commercial signals will be available. The first signal, which is designated L5, will be broadcast over a carrier frequency of 1176.45 MHz. The second signal will be added to the existing L2 carrier frequency. These new signals are intended to modernize the GPS standard by facilitating higher accuracy and availability for critical commercial applications, including primary aircraft navigation, life-saving rescue operations, and so forth. In time, these critical civilian applications will require system availability and accuracy comparable to that required by the military today.

The addition of anti-jam capability to existing military GPS systems will, in many cases, present the issue of replacing existing single-element Fixed Reception Pattern Antennas (FRPAs), which are relatively small, with a larger CRPA array and also an antenna electronics (AE) unit. With existing physical and budgetary constraints, array size and cost will be prime discriminators during procurement for this transition.

Most existing CRPA array designs use microstrip patch antenna elements. These elements are attractive because they are relatively simple in design, exhibit a low profile, and have performance characteristics which are well understood. The existing state-of-the-art CRPA arrays (which utilize patches) can provide the anti-jam performance required for most, if not all, of the projected military applications. However, the size and cost of existing CRPA arrays will be a significant impediment to their proliferation. In this regard, existing 7-element GAS-1 CRPA arrays are typically about 14 inches in diameter, and can each cost as much as $12,000.

Existing GAS-1 antennas are too large to fit on many aircraft, and there is a need for a smaller array that will meet many or all requirements of the U.S. military. In order to provide a smaller array, it is necessary to shrink the size of the antenna elements, and/or position them closer together. On the other hand, to be an efficient radiator, an antenna element typically needs to be a certain size. For example, a single antenna element normally needs to be at least a quarter wavelength to a half wavelength in size in order to operate efficiently. An array would need to be larger. In fact, electrically small antennas usually exhibit degraded performance (reduced bandwidth, efficiency, and so forth), which can greatly hinder the overall system performance. An electrically small antenna which is efficient and broadband is highly desirable.

It is possible to make existing CRPA patch elements physically smaller by using a substrate material which has a high dielectric constant (loading). These smaller loaded elements can, in theory, be positioned more closely together, in order to form a smaller array. However, there are performance and other sacrifices associated with this approach. First, the dielectric loading tends to decrease the element's bandwidth and efficiency, and to increase the element's weight and cost. Narrow bandwidth coupled with manufacturing and material tolerances can lead to significant production problems, and can ultimately drive up the cost of the array. Second, testing has shown that small loaded patch elements can exhibit very high element-to-element coupling values when they are separated by a distance of one-third wavelength or less. This increased coupling leads to degraded anti-jam performance.

Consequently, there is a need for a cheaper and smaller CRPA array which provides acceptable anti-jam performance and which is less dependent on manufacturing and material variations. Some associated technical problems are that unloaded broadband antenna elements tend to be large (the opposite of what is needed), and the close element-to-element spacing needed for a reduced-size array tends to degrade the performance of the antenna and inhibit the overall system's ability to cancel the interfering or jamming signals.

SUMMARY OF THE INVENTION

A first form of the present invention involves an antenna element which includes a section that is electrically non-conductive, a plurality of electrically conductive patches that are provided on the section and that each face in a predetermined direction, a feed arrangement electrically coupled to the patches, and an annular strip of conductive material supported on the section and extending around the patches free of electrical contact with the patches.

A different form of the invention involves a first antenna element and a plurality of second antenna elements disposed at spaced locations around the first antenna element, each antenna element including a section that is electrically non-conductive, a plurality of electrically conductive patches that are provided on the section and that each face in a predetermined direction, a feed arrangement electrically coupled to the patches, and an annular strip of conductive material supported on the section and extending around the patches free of electrical contact with the patches.

Yet another form of the invention involves: forming a plurality of electrically conductive patches on an electrically non-conductive section, in a manner so that the patches each face substantially in a predetermined direction; providing on the section an annular strip of conductive material which extends around the patches free of electrical contact with the patches, the section, the patches and the annular strip being parts of an antenna element; and effecting one of transmission and reception of an electromagnetic signal through the patches.

Still another form of the invention involves: forming a plurality of electrically conductive patches on each of a plurality of non-conductive sections, in a manner so that the patches each face substantially in a predetermined direction; providing on each section an annular strip of conductive material which extends around the patches thereon free of electrical contact with the patches, wherein each section, the patches thereon and the annular strip associated therewith are parts of a respective one of a plurality of antenna elements; and positioning the antenna elements so that a first antenna element has a plurality of second antenna elements disposed at spaced locations therearound.

BRIEF DESCRIPTION OF THE DRAWINGS

A better understanding of the present invention will be realized from the detailed description which follows, taken in conjunction with the accompanying drawings, in which.

DETAILED DESCRIPTION OF THE INVENTION

Figure 1:
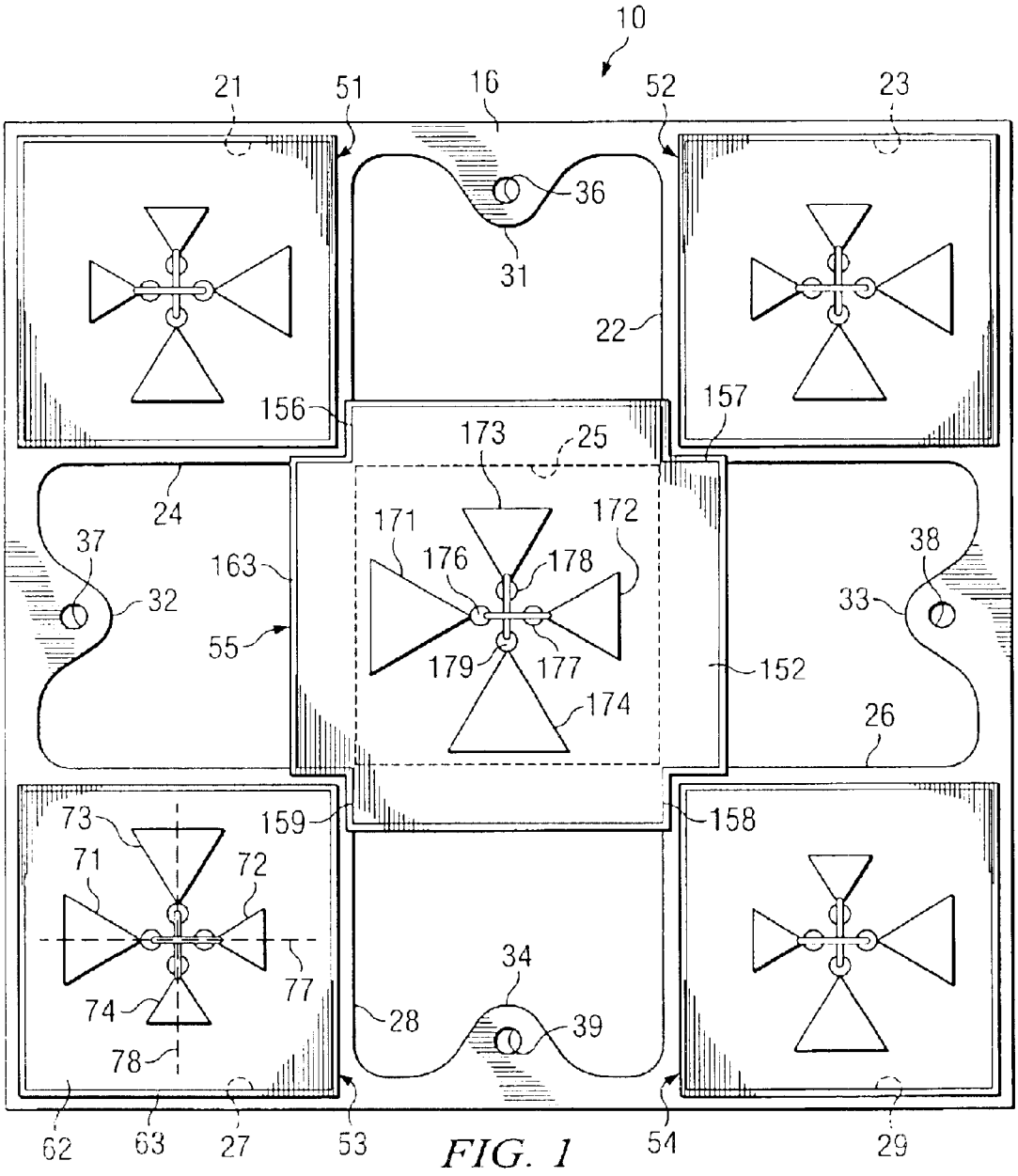
FIG. 1 is a diagrammatic top view of an antenna array which embodies aspects of the present invention.
Figure 2:
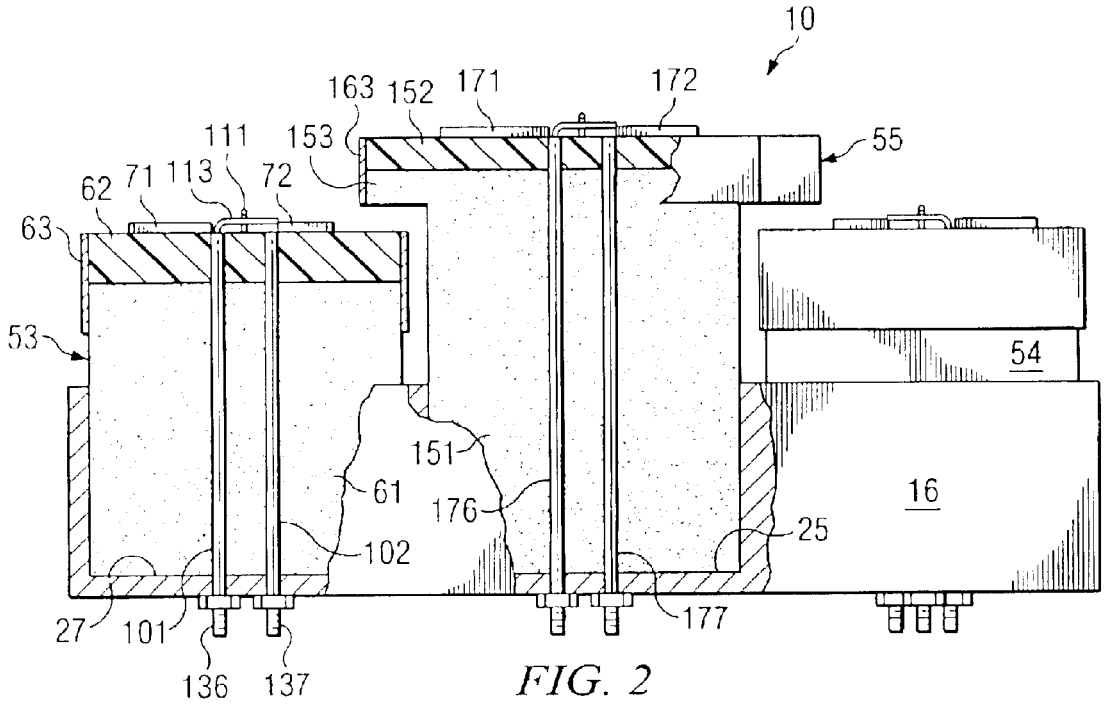
FIG. 2 is a diagrammatic fragmentary side view of the antenna array of FIG. 1.

FIG. 1 is a diagrammatic top view of an apparatus which is a five-element antenna array 10. FIG. 2 is a diagrammatic fragmentary front view of the antenna array 10 of FIG. 1. In an operational configuration, a not-illustrated radome of a known type would typically be provided above the antenna array 10. However, for clarity and convenience, the radome is omitted from the accompanying drawings. In the drawings, the orientation of the antenna array 10 is an exemplary orientation selected for convenience in explaining the structure and operation of the antenna array 10. The antenna array 10 is capable of operating in a variety of other orientations.

The antenna array 10 in the disclosed embodiment is configured for use in a global positioning satellite (GPS) system, but this is an exemplary application, and the present invention is not limited to GPS systems. The antenna array 10 is an array of a specialized type which is commonly referred to as a controlled reception pattern antenna (CRPA). CRPA arrays work well in conjunction with integrated electronics to adaptively cancel or null unwanted signals. Consequently, these arrays and the associated electronics are often referred to generically as anti-jam antenna systems.

In the disclosed embodiment, the antenna array 10 is configured for use with GPS frequency L1 (1.227 GHz), and GPS frequency L2 (1.575 GHz). However, as noted above, the antenna array 10 is not restricted to GPS applications. Further, the antenna array 10 could be used for other applications that involve lower or higher frequencies. At higher frequencies, the antenna array 10 could have a smaller size, in dependence on the particular frequencies of operation, and at lower frequencies the array 10 would have a larger size, in dependence on the particular frequencies of operation.

As evident from FIG. 1, the antenna array 10 has an overall shape in a top view which is approximately a square, and in the disclosed embodiment this square has a size of about 7 inches by 7 inches. The antenna array 10 has a height of about 3.5 inches. The antenna array 10 includes a housing or base 16 which is approximately square in a top view, with horizontal top and bottom surfaces, and vertical side surfaces. The base 16 is made from a piece of aluminum, and is thus electrically conductive.

The base 16 has in the upper side thereof a 3 by 3 array of nine cavities 21–29. The cavities 21–29 each extend vertically downwardly into the base 16 from the top surface thereof. The cavities 21–29 are of equal size, and each have approximately a square shape in the top view of FIG. 1. Each of the cavities 21–29 has four vertical side surfaces, and a horizontal bottom surface. Four of the nine cavities, which are cavities 22, 24, 26 and 28, each have a respective platelike tab 31–34 which projects horizontally inwardly from a top edge of the outer wall of that cavity. Each of the tabs 31–34 has a respective threaded hole 36–39 extending vertically through it, and these holes can be used to removably secure the not-illustrated radome in place.

The antenna array 10 includes five antenna elements 51–55, each of which has a lower end supported in a respective one of the five cavities 21, 23, 27, 29 and 25. The four outer antenna elements 51–54, which are referred to as auxiliary antenna elements, are all identical to each other. The center antenna element 55, which is referred to as a reference antenna element, is slightly different from the auxiliary antenna elements 51–54, in a manner explained later. The auxiliary antenna element 53 will be described first.

The antenna element 53 includes a foam block 61 of generally rectangular shape. In the disclosed embodiment, the foam 61 is a rigid, non-conductive, closed cell foam made of polymethacrylimide, and can be obtained commercially from Northern Fiber Glass Sales, Inc. of Hampton, N.H. under the trade name ROHACELL. This foam material is electromagnetically inert, but provides structural rigidity to the antenna is element. From an electromagnetic perspective, the foam 61 could optionally be omitted, without significantly affecting the electromagnetic operation of the antenna element.

The foam block 61 has a substantially square shape in a top view, with outside dimensions that are only slightly smaller than the inside dimensions of the associated cavity 27. In a side view (FIG. 2), the foam block 61 has a rectangular shape. The lower portion of the foam block 61 is disposed within the cavity 27, and the upper end of the foam block projects a short distance above the top surface of the base 16.

The antenna element 53 also includes a layer 62 of a dielectric material. The dielectric layer 62 is fixedly secured to the top surface of the foam block 61, for example using an epoxy adhesive of a known type. In a top view, the dielectric layer 62 is square, and has dimensions which are substantially the same as those of foam block 61, so that each side surface of the dielectric layer 62 is substantially flush with a respective side surface of the foam block 61.

In the disclosed embodiment, the dielectric layer 62 is made of a relatively inexpensive dielectric material commonly known as FR4. FR4 material is a commercially available, glass-reinforced epoxy which has a dielectric constant in the range of about 4.0 to 4.5, and which is also sometimes referred to as GFG or G10. The FR4 material is much cheaper and easier to process than many other common radio frequency (RF) or microwave materials. The dielectric layer 62 can be made from a single solid piece of FR4 material, or instead from a laminate of several layers of FR4 material. Alternatively, it would be possible to fabricate the dielectric layer 62 from any of a number of different dielectric materials, without significantly altering the electromagnetic operation of the antenna element 53.

The antenna element 53 also includes an electrically conductive fence or strip 63. The strip 63 is annular, and extends completely around the dielectric layer 62 and an upper portion of the foam block 61. In the disclosed embodiment, the strip 63 is adhesively coupled to the dielectric layer 62 and foam block 61, for example by a known epoxy adhesive, or by any other suitable known adhesive. In the disclosed embodiment, the strip 63 is made of copper, but it could alternatively be made of any other suitable material which is electrically conductive. In the disclosed embodiment, the strip 63 has a width (vertical height) which is approximately twice the vertical thickness of the dielectric layer 62. However, it would alternatively be possible to adjust the width of the strip 63, in order to vary the electrical characteristics of the antenna element 53.

The antenna element 53 includes four antenna elements or patches 71–74, which are each disposed on the top surface of the dielectric layer 62. The patches 71–74 are each made of copper, but could alternatively be made of some other electrically conductive material. In the disclosed embodiment, the dielectric layer 62 and the patches 71–74 are fabricated by commercially purchasing a large sheet that has a sandwich configuration, in which a thin layer of copper is provided on each side of a layer of dielectric material. A square section is cut from this sheet in a size appropriate for the dielectric layer 62, and all of the copper material on the bottom side of the dielectric layer is removed through chemical etching or mechanical milling. Further, selected portions of the copper layer on the upper side of the dielectric layer are removed through chemical etching or mechanical milling, in order to leave only the four patches 71–74 on the dielectric layer. It will be recognized, however, that the dielectric layer 62 and the patches 71–74 could alternatively be fabricated in some other manner.

Each of the patches 71–74 has substantially the shape of an equilateral triangle, such that the three apexes of each patch each have an angle of 60°. The patches 72 and 74 are slightly smaller in size than the patches 71 and 73, for reasons discussed later. The patches 71 and 72 are disposed at spaced locations along an imaginary line 77, such that each has an apex nearest the other, and such that each is effectively bisected by the line 77. The patches 73 and 74 are arranged in a similar manner along an imaginary line 78, which is perpendicular to the line 77. The imaginary lines 77 and 78 intersect at a point which is located centrally between all four patches 71–74. The patches 71 and 72 serve as a first bowtie antenna element, and the patches 73 and 74 serve as a second bowtie antenna element, where the two bowties are orthogonal to each other.

Figure 3:
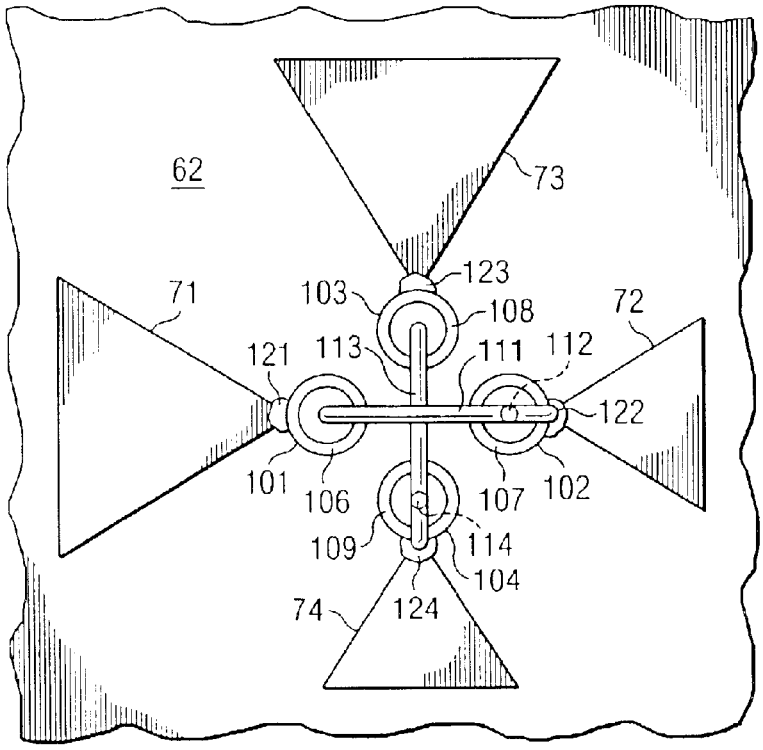
FIG. 3 is a diagrammatic fragmentary top view showing in an enlarged scale a portion of an antenna element which is a component of the antenna array of FIG. 1.

FIG. 3 is a diagrammatic fragmentary top view of a central portion of the antenna element 53, and shows this portion in a substantially enlarged scale. With reference to FIGS. 2 and 3, the antenna element 53 includes four coaxial cables 101–104, which are approximately parallel and extend vertically through the dielectric layer 62, the foam block 61, and a bottom wall of the housing 16. Each of the cables 101–104 has its upper end disposed approximately flush with the top surface of the dielectric layer 62, and adjacent an apex of a respective one of the patches 71–74. Each of the cables 101–104 includes a respective electrically-conductive outer conductor or shield 106–109, a respective electrically-conductive inner conductor 111–114, and a non-conductive material or sleeve which is disposed concentrically between the inner and outer conductors in order to electrically insulate them from each other. Each of the cables 101–104 may optionally have a sleeve-like layer of electrically-insulating material provided around the outside of the outer conductor.

With reference to FIG. 3, each of the outer conductors 106–109 is soldered to the adjacent apex of a respective one of the patches 71–74, as indicated at 121–124. The inner conductors 112 and 114 of the cables 102 and 104 are cut so that their upper ends are approximately flush with the top surface of the dielectric layer 62. The upper ends of the inner conductors 112 and 114 are not electrically coupled to any of the patches or other structure on top of the dielectric layer 62.

The inner conductor 113 from the cable 103 is bent to extend to a location in the region of the cable 104, and is soldered to either the outer conductor 109 of the cable 104 or the adjacent apex of the patch 74. The inner conductor 113 does not engage the outer conductor 108 of its own cable or the inner conductor 114 of the cable 104. In a similar manner, the inner conductor 111 of the cable 101 is bent so as to extend to a location adjacent the cable 102, and is soldered to either the outer conductor 107 of the cable 102, or the adjacent apex of the patch 72. The inner conductor 111 does not touch the outer conductor 106 of its own cable, the inner conductor 113 of cable 103, or the inner conductor 112 of cable 102.

The patch 72 is thus coupled to the inner conductor 111 and, during operation of the antenna element 53, the inner conductor 111 will function to some extent as part of the patch 72. In contrast, the other patch 71 of that bowtie element is not coupled to the center conductor of any of the four cables 101–104. This is why, as mentioned above, the patch 72 has a physical size which is slightly smaller than the physical size of the patch 71.

More specifically, the relative sizes of the patches 71 and 72 are selected so that the combined electrical effect of the patch 72 and the attached inner conductor 111 is approximately equal to the electrical effect of the patch 71 by itself. In a similar manner, the patch 74 is selected to be slightly smaller than the patch 73, so that the combined electrical effect of the patch 74 and the inner conductor 113 is approximately equal to the electrical effect of the patch 73. The patches of a given antenna element can be physically trimmed at their outer edges, to thereby adjust their sizes in order to obtain an appropriate impedance match.

Each of the coaxial cables 101–104 is coupled at its lower end to a respective coaxial connector which is disposed against a bottom surface of the base 16, for example as shown at 136 and 137 in FIG. 2 for the cables 101 and 102. Alternatively, instead of providing coaxial connectors such as those depicted at 136–137, each cable could extend to a location remote from the antenna array 10. The four coaxial cables 101–104 collectively serve as a feed arrangement for the antenna element 53.

As mentioned above, the antenna elements 51–52 and 54 are each substantially identical to the antenna element 53. Accordingly, the structure of the antenna elements 51–52 and 54 is not described here in detail. Turning to the reference antenna element 55 at the center of the array 10, the structure of the antenna element 55 is similar in many respects to the structure of the antenna element 53. However, there are some differences, and the following discussion addresses primarily the differences.

Referring to FIGS. 1 and 2, the reference antenna element 55 has a foam block 151 which is made of the same material as the foam block 61. The foam block 151 has a lower portion with approximately the same size and shape as the foam block 61, except that the lower portion of the foam block 151 has a vertical height which is somewhat greater than the vertical height of the foam block 61, as evident from FIG. 2. At its upper end, the foam block 151 has a lip or flange 153, which projects outwardly beyond the lower portion of block 151 on all sides thereof. The foam block 151 has its lower end disposed in the cavity 25 of the base 16. The underside of the flange 153 is disposed at a location which is slightly vertically higher than the top surface of the dielectric layer 62 of the antenna element 53.

The antenna element 55 includes a dielectric layer 152, which is made of the same material as the dielectric layer 62 of antenna element 53. However, as evident from FIG. 1, the dielectric layer 152 is somewhat larger in horizontal directions than the dielectric layer 62, and is congruent with the flange 153 of the block 151. The dielectric layer 152 and flange 153 each have approximately a square shape, except that small, square notches 156–159 are provided at the corners of each. Consequently, in the top view of FIG. 1, the overall shape of the dielectric layer 162 and flange 153 is approximately that of a cross. The notches 156–159 reduce the extent to which the dielectric layer 152 may tend to interfere with the electrical operation of any of the auxiliary antenna elements 51–54.

The reference antenna element 55 has an electrically conductive fence or strip 163 which extends along and is fixedly secured to the peripheral edges of the dielectric layer 152 and flange 153. As evident from the top view of FIG. 1, the strip 163 is annular, and has a shape which is approximately the outline of a cross.

As shown in FIG. 1, the reference antenna element 55 includes four triangular patches 171–174, which are provided on the top surface of the dielectric layer 152. The antenna element 55 includes four coaxial cables 176–179, which serve as a feed arrangement, and which are operatively coupled to the patches 171–174 in a manner similar to that discussed above in association with FIG. 3 for the antenna element 53. The patches 171–174 of the reference antenna element 55 are proportionally larger than the patches of the auxiliary antenna elements 51–54, by a factor of approximately 26%. The outside dimensions of the dielectric layer 152 of the reference antenna element 55 are proportionally larger than the outside dimensions of the dielectric elements of the auxiliary antenna elements 51–54, by a factor of approximately 36%.

Figure 4:
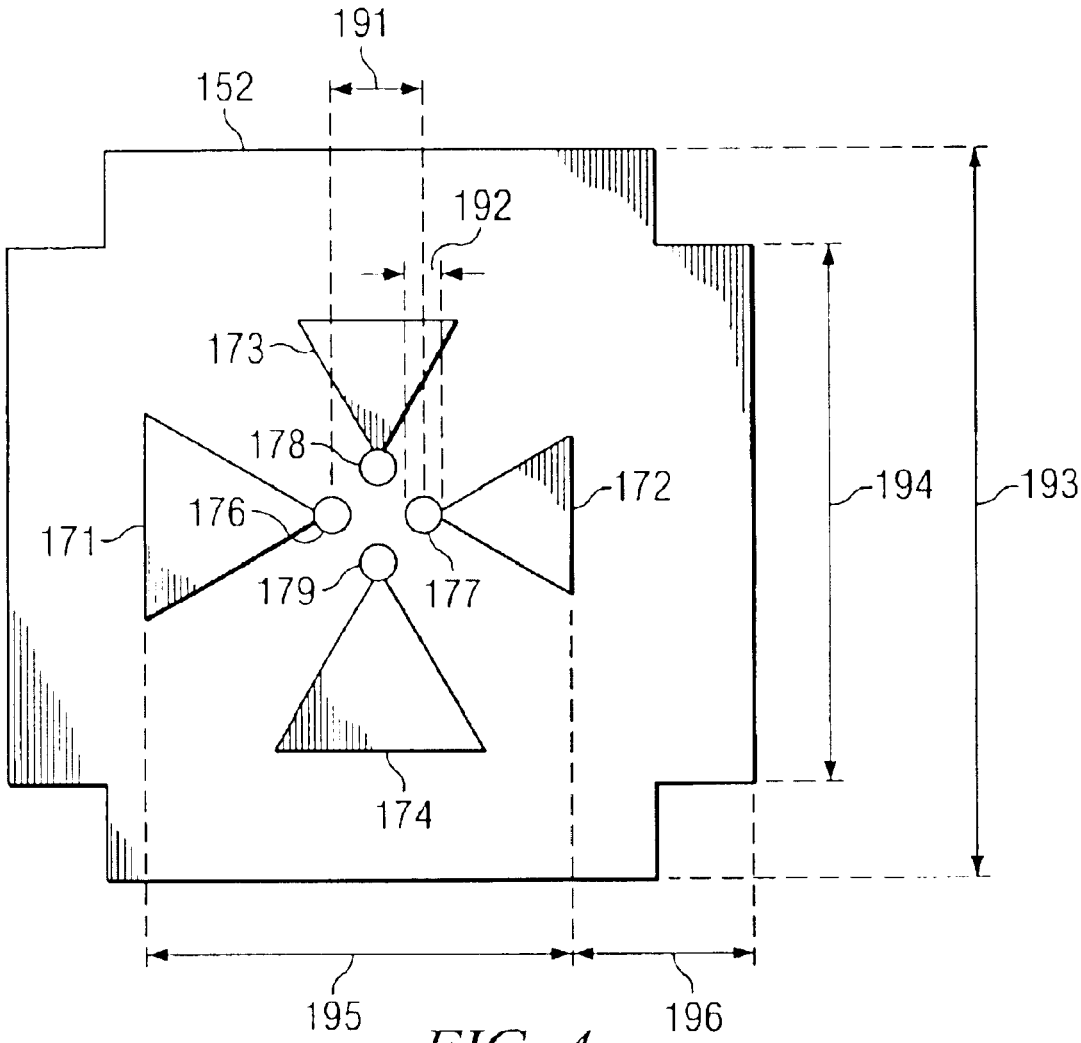
FIG. 4 is a diagrammatic top view of a different antenna element from the antenna array of FIG. 1.

FIG. 4 is a diagrammatic top view which shows selected parts of the reference antenna element 55 in an enlarged scale, including the dielectric layer 152, the patches 171–174 and the coaxial cables 176–179. In the disclosed embodiment, dimension 191 is 0.380 inch, dimension 192 is 0.141 inch, dimension 193 is 3.000 inch, dimension 194 is 2.100 inch, dimension 195 is 1.770 inch, and dimension 196 is 0.700 inch. Of course, as discussed above, the actual size of the structure shown in FIG. 4 may be proportionally larger or smaller, for example in dependence on the specific frequencies at which the antenna array 10 is to operate.

If the reference antenna element 55 had substantially the same size as the auxiliary antenna elements 51–54, the reference antenna element 55 would tend to have a higher operational frequency range than the auxiliary antenna elements 51–54. Consequently, by making the reference antenna element 55 proportionally larger, as discussed above, the reference antenna element 55 is configured to operate in the same frequency range as the auxiliary antenna elements. Moreover, the larger size of the reference antenna element 55 helps to reduce element-to-element coupling between the reference antenna element and the auxiliary antenna elements, and also avoids degraded input impedance match and pattern coverage for the reference antenna element 55.

Figure 5:
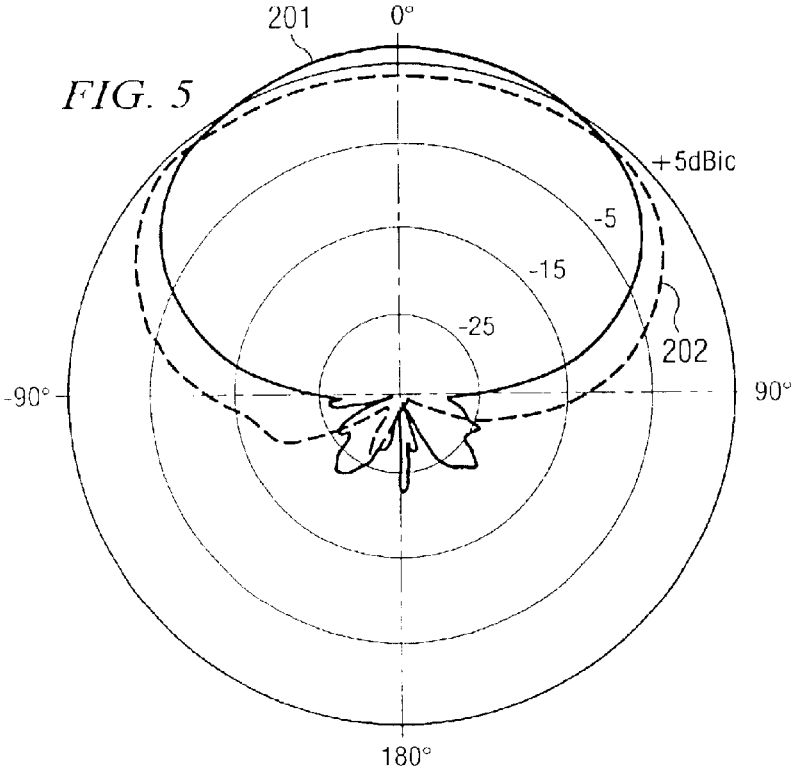
FIGS. 5 and 6 are graphs showing reception patterns at different frequencies for an antenna element in the antenna array of FIG. 1, in comparison to reception patterns for a pre-existing antenna element.

FIG. 5 is a graph showing two radiation patterns relating to the lower GPS frequency L1 (1.227 GHz). In particular, the solid line 201 shows the reception pattern for the antenna element 53 of FIG. 1. The broken line 202 shows a comparable reception pattern for a not-illustrated pre-existing antenna element, which is generally similar to the antenna element 53, except that its four triangular patches are all the same size, it does not have around its dielectric layer an electrically conductive strip which is comparable to the strip 63, and it does not have an electrically conductive cavity which is comparable to the cavity 27.

Figure 6:
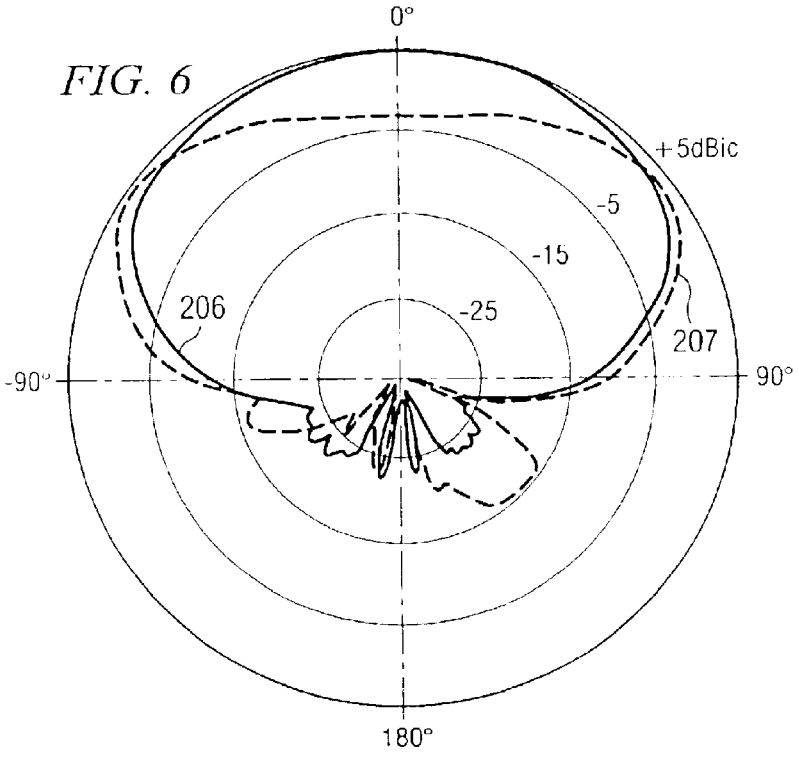

FIG. 6 is a graph showing two radiation patterns relating to the upper GPS frequency L2 (1.575 GHz). In particular, the solid line 206 shows the reception pattern for the antenna element 53 of FIG. 1. The broken line 207 shows the reception pattern for the not-illustrated, pre-existing antenna element discussed above in association with FIG. 5. It will be noted from FIGS. 5 and 6 that the reception patterns for the antenna element 53 are relatively broad in spatial configuration, with peak gains of approximately 6 to 7 dBic at each of the frequencies L1 and L2. In this regard, losses from the cables and a 90° hybrid used for the feed arrangement were not removed, and added approximately 1.2 dB of loss in each graph. In FIG. 6, a significant difference between the illustrated reception patterns 206 and 207 is that the pattern 207 for the pre-existing antenna element exhibits a distinct bifurcation, whereas the pattern 206 for the antenna element 53 exhibits no significant bifurcation.

In regard to the auxiliary antenna element 53, the provision of the conductive strip 63 around the dielectric layer 62 permits a reduction in the size of the antenna element 53 in horizontal directions by a factor of approximately 24%. The provision of the conductive cavity 27 in the base 16 facilitates a reduction of approximately 20% to 25% in the vertical height of the antenna element 53, and allows the antenna element to be substantially contained inside a cavity in a ground plane.

The auxiliary antenna elements 51–54 are substantially identical to each other, and the reference antenna element 55 is similar to them. However, with reference to FIG. 1, it will be recognized that the foam block 61 of each of these antenna elements can be inserted into the associated cavity in the base 16 with any one of four different orientations. Similarly, the foam block 151 of the reference antenna element 55 can be inserted into its cavity with any one of four different orientations. The selection of an appropriate orientation for each antenna element is referred to as "clocking" the antenna element. It will be noted that the auxiliary antenna elements 51–52 and 54 each have their smaller antenna patches to the upper and left sides as viewed in FIG. 1, and the larger patches to the lower and right sides. In contrast, the auxiliary antenna element 53 has its smaller patches to the lower and right sides in FIG. 1, and its larger patches to the upper and left sides. The reference antenna element 55 has its smaller patches to the upper and right sides in FIG. 1, and its larger patches to the lower and left sides.

Through selection of an appropriate clocking position for each antenna element, electromagnetic interaction between the antenna elements can be minimized, in order to improve overall performance of the antenna array 10. Even where the spacing between the centers of the antenna elements is less than about one-third wavelength, the element-to-element coupling is typically about −13 dB to −14 dB, which represents a significant improvement in comparison to pre-existing antenna arrays that have similar spacing.

As discussed above, the embodiment of FIG. 1 has an electrically-conductive base 16 with several cavities that are each associated with a respective antenna element. In an alternative configuration, cavities for the antenna elements are each defined by a respective different physical part, where each such part is an upwardly-open container that is made from an electrically-conductive material and has thin walls. The use of such a thin-walled cavity for each antenna element appears to provide some improved performance, in that the element match is slightly better tuned, the low-angle axial ratio is decreased, and the pattern coverage is increased because the pattern is less directive.

In a different variation, which is not separately illustrated, each of the antenna elements 51–55 can have four tubes that extend vertically through it, and each tube can have a respective one of the coaxial cables of the feed arrangement extending through it. Each tube can be made of brass, and the shield of each cable can be soldered to the upper or lower end of the tube through which it extends. This can facilitate the removal and replacement of cables with little or no damage to them.

The antenna elements 51–55 can each be referred to as a loaded bowtie antenna element in a cavity, or an "LBC" element. As discussed later, these LBC elements each provide good electrical performance in a size which is more compact than comparable pre-existing antenna elements. In particular, each LBC element can be approximately 20% smaller than a comparable pre-existing antenna element operating in the same band, without sacrificing bandwidth. Each LBC element may be less than about 0.4 wavelength tall, and less than about one-third wavelength square. Each LBC element exhibits a 40% to 50% impedance bandwidth, good efficiency, and a relatively consistent and broad reception pattern. In this regard, and as discussed later, the typical bandwidth-limiting bifurcation exhibited by pre-existing antenna elements at higher frequencies is avoided by the LBC element.

With reference to FIGS. 1-3, the four coaxial cables 101–104 effectively form two orthogonal shorted two-wire transmission lines, each of which serves as a balanced-to-unbalanced (BALUN) transformer and a shorted matching stub. Consequently, the overall configuration which results has two LBC element outputs (one for each dipole), and these outputs can be combined using a 90° hybrid in order to produce a desired right-hand circular polarization (RHCP). Alternatively, the same hybrid could be utilized to produce left-hand circular polarization (LHCP), if desired. The outer conductors 106–109 of each cable are electrically coupled to the conductive material of the base 16 which forms the cavity for each element, for example by soldering.

In the disclosed embodiment, the cavities and foam blocks each have approximately a square shape in a top view, but they could alternatively have the shape of some other polygon, such as a hexagon or octagon, in order to provide a larger number of clocking positions for each element. The diameters of the coaxial cables 101–104, and the spacing between them, can be adjusted in order to vary the performance of the antenna element 53.

The present invention provides a number of technical advantages. One such advantage relates to the provision of antenna elements which are compact in size, and have a relatively large bandwidth. The antenna elements are efficient, and have a broad radiation pattern which is relatively consistent across a broad bandwidth.

Advantages of the disclosed antenna array include the fact that it is very compact and provides good performance, including good anti-jam capability, good element impedance matching, good pattern coverage, a wide bandwidth, and limited element-to-element coupling. The antenna array has a weight which is significantly lower than that of a pre-existing array which operates in the same waveband. The disclosed antenna array also has a manufacturing cost which is significantly less than that of pre-existing antenna arrays with comparable performance, and is backward compatible with the antenna electronics of at least some pre-existing systems.

Although selected embodiments have been illustrated and described in detail, it will be understood that various substitutions and alterations are possible without departing from the spirit and scope of the present invention, as defined by the following claims.

What is claimed is:

1. An apparatus, comprising an antenna element which includes:

a section which is electrically non-conductive;

a plurality of electrically conductive patches which are provided on said section;

a central feed arrangement electrically coupled to each of the plurality of patches, the plurality of patches disposed at spaced apart locations that are radial to the central feed arrangement; and an annular strip of conductive material supported on said section and extending around said patches free of electrical contact with said patches.

2. An apparatus according to claim 1, wherein said antenna element further includes a portion which is electrically conductive and has therein a cavity that faces said section, said patches being provided on a side of said section opposite from said portion with said cavity.

3. An apparatus according to claim 2, wherein said section includes a dielectric layer disposed adjacent said patches, said annular strip extending adjacent a peripheral edge of said dielectric layer.

4. An apparatus according to claim 3, wherein said section includes a portion which is made of an electromagnetically inert material and which has first and second ends, said first end being disposed within said cavity, and said dielectric layer being supported by said second end.

5. An apparatus according to claim 1, wherein said patches include spaced first, second, third and fourth patches which each have an apex and progressively increase in width in a direction away from the apex, said first and second patches being oriented with said apexes thereof facing each other so as form a first bowtie, and said third and fourth patches being oriented with said apexes thereof facing each other so as form a second bowtie, said second bowtie being orthogonal to said first bowtie.

6. An apparatus according to claim 5, wherein each of said first, second, third and fourth patches is substantially an equilateral triangle.

7. An apparatus according to claim 5, wherein said feed arrangement includes first and second coaxial cables which each extend through said section to locations between and respectively adjacent said apexes of said first and second patches, and third and fourth coaxial cables which each extend through said section to locations between and respectively adjacent said apexes of said third and fourth patches;

wherein an outer conductor of each said cable is electrically coupled to the apex adjacent thereto;

wherein center conductors of said first and third cables extend to and are respectively electrically coupled to said second and fourth patches; and wherein center conductors of said second and fourth cables are each free of electrical coupling to any of said first, second, third and fourth patches.

8. An apparatus according to claim 7, wherein said second and fourth patches are respectively smaller than said first and third patches.

9. An apparatus, comprising a first antenna element and a plurality of second antenna elements disposed at spaced locations around said first antenna element, each said antenna element including:

a section which is electrically non-conductive;

a plurality of electrically conductive patches which are provided on said section, at spaced apart locations that are radial to a central axis;

a feed arrangement electrically coupled to said patches; and an annular strip of conductive material supported on said section and extending around said patches free of electrical contact with said patches.

10. An apparatus according to claim 9, wherein said section and said patches of said first antenna element are proportionally larger in size than said section and said patches of each said second antenna element.

11. An apparatus according to claim 9, wherein each said antenna element further includes a portion which is electrically conductive and has therein a cavity that faces said section, said patches of each said antenna element being provided on a side of said section thereof opposite from said portion thereof with said cavity.

12. An apparatus according to claim 9, including an electrically conductive portion having a plurality of cavities therein, each said cavity facing and being aligned with said section of a respective said antenna element, and said patches of each said antenna element being provided on a side of said section thereof opposite from said portion with said cavities.

13. An apparatus according to claim 12, wherein said section of each said antenna element includes a dielectric layer disposed adjacent said patches, said annular strip of each said antenna element extending adjacent a peripheral edge of said dielectric layer thereof.

14. An apparatus according to claim 13, wherein said section of each said antenna element includes a portion which is made of an electromagnetically inert material and which has first and second ends, said first end being disposed within a respective said cavity, and said second end supporting the associated dielectric layer.

15. An apparatus according to claim 9, wherein said section of each said antenna element includes a dielectric layer disposed adjacent said patches, said annular strip of each said antenna element extending adjacent a peripheral edge of said dielectric layer thereof; and wherein said patches of said first antenna element are offset in said predetermined direction from said patches of each said second antenna element.

16. An apparatus according to claim 15, wherein said dielectric layers of said second antenna elements are each smaller than said dielectric layer of said first antenna element.

17. An apparatus according to claim 16, wherein said dielectric layer of said first antenna element has along said peripheral edge thereof a plurality of notches at circumferentially spaced locations which are each aligned with a respective said second antenna element.

18. An apparatus according to claim 9, wherein said patches of each said antenna element include spaced first, second, third and fourth patches which each have an apex and progressively increase in width in a direction away from the apex, said first and second patches being oriented with said apexes thereof facing each other so as form a first bowtie, and said third and fourth patches being oriented with said apexes thereof facing each other so as form a second bowtie, said second bowtie being orthogonal to said first bowtie.

19. An apparatus according to claim 18, wherein said feed arrangement of each said antenna element includes first and second coaxial cables which each extend through said section to locations between and respectively adjacent said apexes of said first and second patches, and third and fourth coaxial cables which each extend through said section to locations between and respectively adjacent said apexes of said third and fourth patches;

wherein an outer conductor of each said cable is electrically coupled to the apex adjacent thereto;

wherein center conductors of said first and third cables extend to and are respectively electrically coupled to said second and fourth patches; and wherein center conductors of said second and fourth cables are each free of electrical coupling to any of said first, second, third and fourth patches.

20. An apparatus according to claim 19, wherein said second and fourth patches of each said antenna element are respectively smaller than said first and third patches thereof.

21. A method, comprising the steps of;

forming a plurality of electrically conductive patches on an electrically non-conductive section;

providing on said section an annular strip of conductive material which extends around said patches free of electrical contact with said patches, said section, said patches and said annular strip being parts of an antenna element;

electrically coupling a central feed arrangement to each of the plurality of patches, the plurality of patches formed at spaced apart locations that are radial to the central feed arrangement; and effecting one of transmission and reception of an electromagnetic signal through said patches.

22. A method according to claim 21, including the step of configuring said antenna element to have a portion which is electrically conductive and has therein a cavity that faces said section, said patches being provided on a side of said section opposite from said portion with said cavity.

23. A method according to claim 22, including the step of configuring said section to have a dielectric layer disposed adjacent said patches, said annular strip extending adjacent a peripheral edge of said dielectric layer.

24. A method, comprising the steps of:

forming a plurality of electrically conductive patches on each of a plurality of nonconductive sections, the plurality of patches disposed on each of the nonconductive sections at spaced apart locations that are radial to a central axis;

providing on each said section an annular strip of conductive material which extends around said patches thereon free of electrical contact with the patches, wherein each said section, said patches thereon and said annular strip associated therewith are parts of a respective one of a plurality of antenna elements; and positioning said antenna elements so that a first said antenna element has a plurality of second said antenna elements disposed at spaced locations therearound.

25. A method according to claim 24, wherein said step of forming said patches is carried out so that said patches of said first antenna element are proportionally larger in size than said patches of each said second antenna element.

26. A method according to claim 24, including the step of configuring each said antenna element to have a portion which is electrically conductive and which has therein a cavity that faces said section, said patches of each said antenna element being provided on a side of said section thereof opposite from said portion thereof with said cavity.

27. A method according to claim 24, including the step of providing an electrically conductive portion having a plurality of cavities therein, each said cavity facing and being aligned with said section of a respective said antenna element, and said patches of each said antenna element being provided on a side of said section thereof opposite from said portion with said cavities.

28. A method according to claim 27, including the step of configuring said section of each said antenna element to include a dielectric layer disposed adjacent said patches, said annular strip of each said antenna element extending adjacent a peripheral edge of said dielectric layer thereof.

29. A method according to claim 24, including the step of configuring each said antenna element to include a dielectric layer disposed adjacent said patches, said annular strip of each said antenna element extending adjacent a peripheral edge of said dielectric layer thereof; and wherein said positioning step is carried out so that said patches of said first antenna element are offset in said predetermined direction from said patches of each said second antenna element.

30. A method according to claim 29, wherein said step of configuring said antenna elements is carried out so that said dielectric layer of each said second antenna element is smaller than said dielectric layer of said first antenna element.

* * * * *

UNITED STATES PATENT AND TRADEMARK OFFICE

CERTIFICATE OF CORRECTION

PATENT NO. : 6,847,328 B1
DATED : January 25, 2005
INVENTOR(S) : Libonati et al.

It is certified that error appears in the above-identified patent and that said Letters Patent is hereby corrected as shown below:

Column 1,
Line 35, after "specific" insert -- aspect --.

Column 4,
Line 67, after "antenna" delete "is".

Signed and Sealed this

Eleventh Day of April, 2006

JON W. DUDAS
*Director of the United States Patent and Trademark Office*